United States Patent [19]

Coeling et al.

[11] Patent Number: 4,896,834

[45] Date of Patent: Jan. 30, 1990

[54] ROTARY ATOMIZER APPARATUS

[75] Inventors: Kenneth J. Coeling, Temperance, Mich.; Richard Weinstein, Toledo, Ohio

[73] Assignee: The DeVilbiss Company, Toledo, Ohio

[21] Appl. No.: 645,560

[22] Filed: Aug. 30, 1984

[51] Int. Cl.[4] ..... B05B 5/04

[52] U.S. Cl. ..... 239/691; 239/296; 239/703; 239/704

[58] Field of Search ..... 239/691–708, 239/223, 296

[56] References Cited

U.S. PATENT DOCUMENTS

| | | | |
|---|---|---|---|
| 2,584,973 | 2/1952 | Andermatt | 239/223 |
| 2,799,532 | 7/1957 | Smart | 239/223 |
| 2,901,178 | 8/1959 | Norris | 239/692 |
| 3,043,521 | 7/1962 | Wampler | 239/214 |
| 3,344,992 | 1/1964 | Norris | 239/705 |
| 4,384,682 | 5/1983 | Sugiyama | 239/703 |
| 4,555,058 | 11/1985 | Weinstein et al. | 239/703 |

FOREIGN PATENT DOCUMENTS

| | | | |
|---|---|---|---|
| 2336183 | 8/1977 | France | 239/703 |

*Primary Examiner*—Andres Kashnikow
*Assistant Examiner*—Michael J. Forman
*Attorney, Agent, or Firm*—Emch, Schaffer, Schaub & Porcello Co.

[57] ABSTRACT

A high speed non-incendive rotary painting assembly including a high voltage power supply, an air supply means and a paint supply means is disclosed. The rotary painting assembly comprises a non-conductive body. A high speed, non-conductive turbine is connected to a non-conductive atomizer bell. In one embodiment, the non-conductive turbine is connected to a non-conductive rotatable shaft which mounts the non-conductive atomizer bell. In another embodiment, the non-conductive shaft is fixed. The non-conductive shaft rotatably mounts a non-conductive turbine and rotary atomizer bell assembly.

5 Claims, 2 Drawing Sheets

ROTARY ATOMIZER APPARATUS

The use of electrostatic rotary spray guns is known in the commercial spray painting field. High voltage power supplies are required to furnish the electrostatic forces in this type of painting apparatus. Common configurations of these electrostatic painting apparatus include both rotating and fixed shafts. Examples of fixed shaft spray guns can be found in Wampler Patent No. 3,043,521, Sedlacski Patent No. 3,000,574 and Bals Patent No. 4,222,523. With the use of high voltage power supplies in both the rotary and fixed configurations the danger of fire or electrical shock is a concern.

It is an object of this invention to reduce these dangers by providing a non-incendive high speed rotary atomizer which employs a minimum number of conductive parts, thereby reducing the danger of electrical shock or fire.

It is also an object of this invention to provide such a non-incendive high speed rotary atomizer in both fixed and rotary shaft configurations.

It is a further object of this invention to provide a novel non-incendive retrofit unit capable of being mounted in place of the conventional air cap on existing automatic and hand gun spray gun equipment.

SUMMARY OF THE INVENTION

The present invention is a non-incendive high speed centrifugal or rotary atomizer. By non-incendive it is meant that the high speed electrostatic unit can be used under full voltage in a methane-air mixture with a very low risk of combustion. The atomizer is made non-incendive by the use of synthetic resins and/or ceramics for a majority of the parts including the atomizer head, shaft, housing and turbine. Certain internal parts do contain metal but are shielded from external ground by the other non-conductive materials. When assembled, the unit greatly reduces the risk of shock or fire.

DETAILED DESCRIPTION OF THE INVENTION

Figure 1:
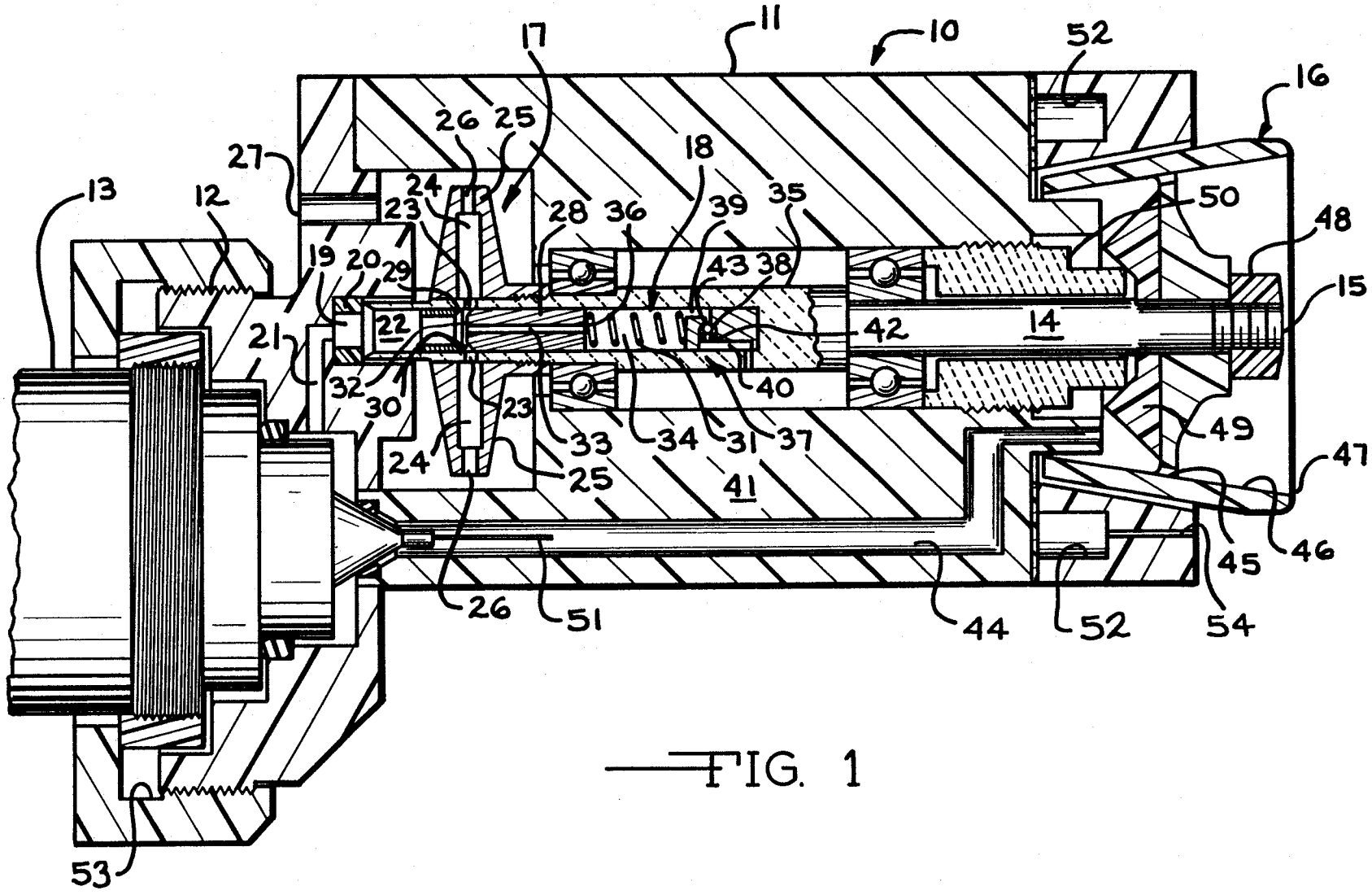
FIG. 1 is a side elevational view in cross-section of a non-incendive rotating shaft high speed rotary atomizer, according to the present invention.

Referring to FIG. 1, a non-incendive high speed rotating shaft rotary atomizer 10 is depicted. The rotary atomizer 10 includes a body 11 which is non-conductive. As with all of the non-conductive portions of the invention, the body 11 can be constructed from a number of non-conductive materials including but not limited to ceramics and synthetic resins. By so doing, any parts that are conductive are shielded by the surrounding non-conductive parts.

The body 11 has a threaded rear body portion 12 for mounting the body 11 to an existing charging apparatus or manifold 13 which contains air, paint and high voltage supplies. Positioned within the body 11 is a non-conductive rotating shaft 14. Connected to the front end 15 of the shaft 14 is a non-conductive rotary bell 16. A non-conductive rotary air turbine 17 is mounted to the rear end of the shaft 14 and drives the bell 16. Positioned intermediate to the turbine 17 and the bell 16 is a turbine governor 18.

The air turbine 17 has a hollow end 19 which is coupled through a suitable rotary seal 20 and air channel 21 to air supply means (not shown) contained in the charging manifold 13. The hollow end 19 defines an interior chamber 22 which communicates through side openings 23 to the interior 24 of the turbine wheel 25. Compressed air normally flows from the charging manifold 13, through the air channel 21, the hollow end 19, the interior chamber 22, side openings 23 and interior 24 to tangentially directed openings 26 on the turbine wheel 25. Thence, the air is vented through a rear opening 27 in the rear of body 11. The air flowing through the turbine wheel 25 causes the turbine wheel 25 to rotate the shaft 14 which in turn rotates the bell 16 at a high rate of speed.

The rate of rotation of the bell 16 is dependent upon the load on the shaft 14, the air flow rate and the air pressure. High speed atomizers, according to the present invention, operate at speeds in excess of 10,000 r.p.m. to as high as 60,000 r.p.m. The electrical charge applied to this apparatus is in the high voltage range generally falling between 40 kv and 100 kv. The speed of the air turbine 17 is controlled by the governor 18 which controls air flow from air channel 21 to the turbine wheel chamber 24. The governor includes a piston 28 which slides within chamber 22 and into and out of engagement with a valve seat 29. The piston 28 has a valve surface 30 which, when abutting the valve seat 29, blocks air flow from the air channel 21 to the turbine wheel chamber 24. A spring 31 urges the piston 28 against the valve seat 29 to block air flow into the turbine wheel chamber 24. At the same time, the compressed air within the chamber 22 acts upon a face 32 of the piston 28 to move the piston 28 against the spring 31, and away from the seat 29. A hole 33 extends through the piston 28 to allow a restricted flow of the compressed air within the chamber 22 through the piston 28 to a rear chamber 34 located between the piston 28 and a portion 35 of the shaft 14. The chamber 34 may be vented to the atmosphere or may be plugged, depending upon the action of the governor required to maintain a constant shaft speed. When the chamber 34 is vented to the atmosphere, the compressed air in the chamber 22 applies a significantly higher force to the piston face 32 than appears at the face 36 on the opposite end of the piston 28. The difference in force is sufficient to compress the spring 31, thereby moving the piston away from the seat 29. On the other hand, if the chamber 34 is not vented to the atmosphere, the compressed air will flow through the piston hole 33 to pressurize the chamber 34 at the same pressure as the chamber 22. Because the forces applied by the compressed air on the faces 32 and 36 of the piston 28 are identical, the spring 31 acts to move the piston 28 into contact with the valve seat 29 to block flow of air from the chamber 22 to the turbine wheel interior 24, thereby slowing the turbine. By modulating the position of the piston 28, the flow of air from the chamber 22 to the turbine wheel interior 24 is modulated to control the speed at which the shaft 14 is rotated.

A centrifugally actuated ball valve 37 controls the air pressure within the chamber 34. A valve seat 38 is formed between a passage 39 and the portion 35. The passage 39 communicates with the chamber 34 and a passage 40 which is vented to the atmosphere through an annular region between the shaft 14 and the tubular extension 41. A tubular plug 42 retains a ball 43 adjacent the valve seat 38 while leaving clearance for the ball 43 to move into and out of contact with the seat 38. The ball 43 is located so that at all times its center is positioned to the side of the axis of the shaft 14 towards the seat 38. Consequently, as the shaft is rotated at an increasing speed, centrifugal force urges the ball 43 against the seat 38 with an increasing force.

In operation the compressed air from the air channel 21 is allowed to flow through the piston hole 33, the chamber 34, the passage 39 and the passage 40 and thence is vented to the atmosphere. Consequently, the chamber 34 will have a pressure near or at atmospheric pressure and the pressure on the piston face 32 will move the piston 28 to allow an unrestricted air flow from the chamber 22 to the turbine wheel interior 24. As the speed of the shaft 14 increases, the ball 43 is forced more tightly against the seat 38 and the pressure within the chamber 34 increases. The air pressure within the chamber 34 acts against the piston face 36 to offset the air pressure acting on the piston face 32. At some increasing turbine speed, the increasing pressure within the chamber 34 along with the pressure of the spring 31 moves the piston 28 to progressively close the air flow passages from the chamber 22 to the turbine wheel interior 24. At this point, the speed of the shaft 14 is controlled at a constant level. Thus, when the load is removed from atomization bell 16, the shaft 14 will tend to accelerate. The piston 28 will move to further close the air flow passage and govern the speed of the shaft 14. The governor controlled speed is thus a function of the turbine air supply pressure.

The rotating bell 16 is connected to the shaft front end 15 by means of a non-conductive nut 48. Paint from the charging manifold 13 is delivered to the bell 16 through a passage 44 and thence through openings 45 to a conical surface 46 on the interior of the bell 16. In this embodiment, a charging needle 51 of the charging manifold 13 charges the paint passing through the passage 44. The electrical charge applied is between 40 k.v. and 100 k.v. As the bell 16 rotates at a high speed, the paint flows radially outward along the surface 46 until it is thrown from an outer edge 47 of the bell 16 in the form of small charged particles. Paint is prevented from flowing back down the shaft 14 by means of a synthetic resin seal 49 which is in line contact with a threaded insert 50 positioned about the shaft 14. A shaping air passageway 52 which is in fluid communication with an air passageway 53 supplies shaping air to a plurality of shaping air holes 54 adjacent the bell 16.

As is evident from the above, the major portions of the embodiment are formed from non-conductive materials. This includes the body 11, the shaft 14, the bell 16 and the turbine 17. The remaining conductive parts are shielded by non-conductive components. Consequently, the present embodiment is able to achieve its non-incendive characteristics.

Figure 2:
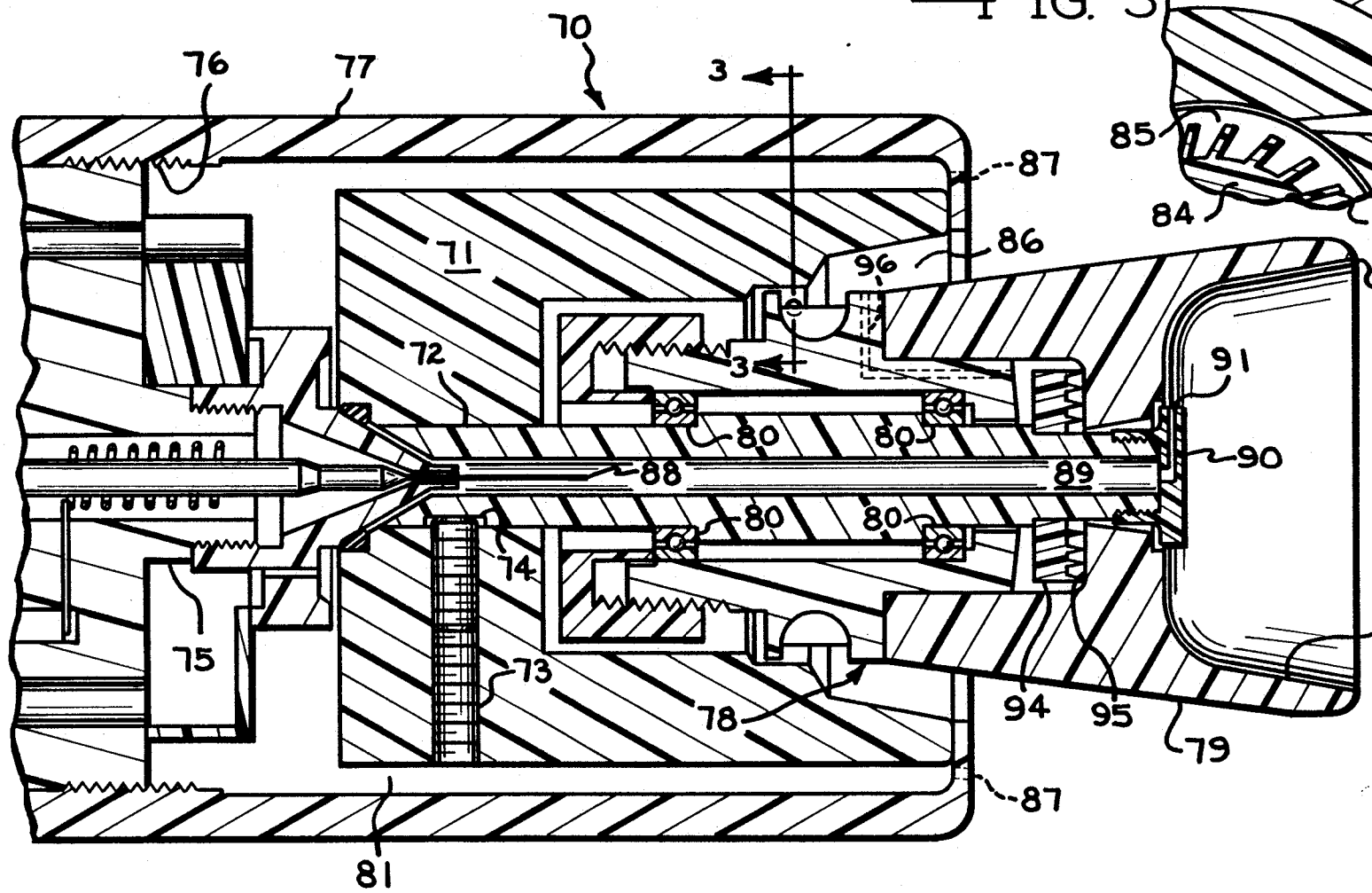
FIG. 2 is a side elevational view in cross-section of a non-incendive non-rotating shaft high speed rotary atomizer, according to the present invention.

A second embodiment of the present invention is shown in FIG. 2. This is a fixed shaft embodiment whereas the embodiment shown in FIG. 1 has a rotating shaft. With the embodiment in FIG. 2 the bell is connected directly to the turbine and both the turbine and the bell rotate about the fixed axis of the shaft.

More particularly, the apparatus 70 of FIG. 2 comprises a non-conductive body 71 with a fixed hollow shaft 72. The shaft 72 is held in position by a set screw 73 which engages a detent 74 in the side of the shaft 72. In an alternative construction the shaft is adhered to the body. In still another embodiment (not shown) the shaft is press fitted to the body.

Connected to and extending into the rear of the body 71 is a charging apparatus or manifold 75 similar in design to that described in FIG. 1. The charging head assembly 75 is threaded and thus engages the threaded portion 76 a mounting ring 77.

Positioned about the rearward portion of the fixed shaft 72 is a non-conductive air turbine 78. A rotary atomizer bell 79 is connected to the front portion of the air turbine 78. The rotary bell 79 and the front portion of the air turbine 78 may also be formed as a single unit (not shown). The turbine 78 and bell 79 rotate freely about the fixed shaft 72. Bearings 80, positioned adjacent the shaft 72 mount the turbine 78 and bell 79 for rotation.

Figure 3:
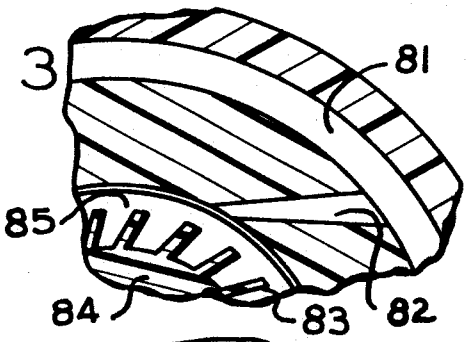
FIG. 3 is a fragmentary cross-sectional view of FIG. 2 taken along line 3—3 of FIG. 2 showing the details of the turbine blades and the air turbine inlet.

Air is supplied to the turbine 78 by the charging manifold 75. As shown in FIG. 3, the air flows through air channel 81 and then inwardly through air channel 82. The air entering channel 82 impinges upon the blades 83 of rotor 84 causing the turbine 78 and thus the bell 79 to rotate. The spent air then exits the turbine chamber 85 through exit 86 outwardly along the outside of the bell 79. In addition, air shaping means are provided through ports 87 which communicate with air chamber 81.

Paint is supplied to the bell 79 by way of the charging manifold 75. When the needle 88 in charging manifold 75 is retracted, paint flows out and around the needle 88 and receives an electrostatic charge from a high voltage supply (not shown) which is connected to and charges the needle 88. Hand guns or automatic spray heads are suitable for charging manifolds 13 and 75. Any number of configurations of manifold structures including the manifolds 13 and 75 may be used with apparatus according to the present invention. Generally, as mentioned above, the manifolds 13 and 75 must include a high voltage supply (40 kv -100 kv), a paint supply and an air supply. Handgun manifolds which may be used in apparatus according to the present invention are disclosed, inter alia, in U.S. Pat. No. 3,471,089 and U.S. Pat. No. 3,591,080.

The paint then travels up the hollow interior 89 of the shaft 72 to a threaded cap 90 which is attached to the end of the fixed shaft 72 adjacent the bell 79. The cap 90 defines a port 91 which communicates with the interior 89 of the shaft 72 thus permitting paint to flow to the interior 92 of the bell 79.

As the bell 79 rotates, paint emitted from the port 91 in the cap 90 flows radially outward along the interior surface 92 of the bell 79 until it is thrown from an outer edge 93 of the bell 79 in the form of small charged particles. Paint is retarded from flowing back into the internal workings of the apparatus 70 by the use of a seal 94 which frictionally engages the rear portion 95 of the bell 79. A passageway 96 communicates with the exhaust air passageway leading to the exit 86 to apply a fluid pressure to the rear of the seal 94.

While the specific embodiments of the present invention shown in FIGS. 1 and 2 are retrofit units, it should be understood that the same non-incendive features can be employed in unitary, non-retrofit equipment. In such cases, the charging apparatus 13, together with the high voltage power supply and the paint and air supplies are incorporated into an integral unit, in accordance with the present invention.

It will be appreciated that various changes and modifications may be made in the above-described non-incendive high speed rotary atomizers without departing from the invention. For example, instead of charging the paint with the needle in the charging head assembly, the paint can be charged by applying a semi-conductive coating to the interior surface of the bell and then applying a voltage to the bell. In addition, other nonconductive material besides ceramics and synthetic resins may be used in constructing the apparatus. Various other changes and modifications also may be made without departing from the spirit or the scope of the following claims.

We claim:

1. A high speed rotary painting assembly, including a high voltage power supply, for supplying a voltage between 40 kv. and 100 kv., and air supply means and a paint supply means, said rotary painting assembly comprising, in combination, a non-conductive body, a longitudinally extending non-conductive shaft mounted within said body, a non-conductive rotary air turbine mounted adjacent said shaft, said non-conductive rotary air turbine having rotational velocities in excess of 10,000 revolutions per minute, a non-conductive high speed rotary atomizing bell operating connected to said non-conductive rotary air turbine and mounted adjacent one end of said non-conductive body, means for feeding paint to said non-conductive rotary atomizing bell, sealing means adjacent said atomizing bell for preventing paint from flowing back down said shaft, said sealing means including a resin seal surrounding said shaft and engaging a non-rotatable insert mounted by said body and surrounding said shaft means in communication with said high voltage power supply for charging paint flowing to said non-conductive rotary atomizing bell and air means for shaping the paint emitted from said painting apparatus.

2. A high speed rotary painting assembly, a high voltage power supply, for supplying a volt between 40 kv and 100 kv., air supply means and a paint supply means; said rotary assembly comprising, in combination, a non-conductive body, a non-conductive rotatable shaft mounted within said body, a non-conductive turbine for driving said shaft, said turbine being capable of rotational velocities in excess of 10,000 revolutions per minute, a rotatable non-conductive paint dispensing means attached to said shaft, means in communication with said high voltage power supply for charging paint flowing to said paint dispensing means, sealing adjacent said paint dispensing means for preventing paint from flowing back down said shaft, said sealing means including a resin seal surrounding said shaft and engaging a non-rotatable insert mounted by said body and surrounding said shaft, and air means for shaping the paint particles emitted from said paint dispensing means.

3. A high speed rotary painting assembly including a high voltage power supply, for supplying a voltage between 40 kv. and 100 kv., an air supply means and a paint supply means said rotary painting assembly comprising, in combination, a non-conductive body, a longitudinally extending non-conductive rotatable shaft within said body, a non-conductive rotary air turbine connected with said shaft, said turbine being capable of rotating said shaft in excess of 10,000 revolutions per minute, a non-conductive rotary atomizing bell operatively connected to one end of said shaft, means in communication with said high voltage power supply for charging paint flowing to said rotary atomizing bell, sealing means adjacent said atomizing bell for preventing paint from flowing back down said shaft, said sealing means including a resin seal surrounding said shaft and engaging a non-rotatable insert mounted by said body and surrounding said shaft, and air means for shaping the paint emitted from said rotary atomizing bell.

4. A high speed rotary painting assembly including a high voltage power supply, for supplying a voltage between 40 kv. and 100 kv, an air supply means and a paint supply means, said rotary painting assembly comprising in combination, a non-conductive body, a non-conductive fixed shaft mounted within said body, a non-conductive turbine mounted to rotate on said non-conductive fixed shaft, said turbine being capable of rotational velocities in excess of 10,000 revolutions per minute, a rotatable non-conductive paint dispensing means connected to said turbine, means for feeding paint to said paint dispensing means, means in communication with said high voltage power supply for charging paint flowing to said paint dispensing means, sealing means adjacent said paint dispensing means for preventing paint from flowing back down said shaft, said sealing means including a non-rotatable circular seal mounted on said shaft adjacent said paint dispensing means, said seal including friction members extending axially for engaging said paint dispensing means and an air means for shaping the paint emitted from said painting apparatus.

5. A high speed rotary painting assembly, including a high voltage power supply, for supplying a voltage between 40 kv. and 100 kv., an air supply means and a paint supply means; said rotary painting assembly comprising in combination, a non-conductive body, a longitudinally extending non-conductive fixed shaft mounted with said body, a non-conductive rotary air turbine mounted to rotate on said non-conductive fixed shaft, said turbine being capable of rotational velocities in excess of 10,000 revolutions per minute, a non-conductive high speed rotary atomizing bell connected to said turbine, means for feeding paint to said bell, sealing means adjacent said atomizing bell for preventing paint from flowing back down said shaft, said sealing means including a non-rotatable circular seal mounted on said shaft said rotary atomizing bell, said seal including friction members extending axially for engaging said rotary atomizing bell, means in communication with said high voltage power supply for charging paint flowing to said non-conductive high speed rotary atomizing bell, and air means for shaping the paint emitted from said painting apparatus.

* * * * *